United States Patent [19]

Davies

[11] Patent Number: 5,011,053

[45] Date of Patent: Apr. 30, 1991

[54] GLOVE SUPPORT APPARATUS

[76] Inventor: Donald C. Davies, 2305 N. 44th St. #257, Phoenix, Ariz. 85008

[21] Appl. No.: 475,235

[22] Filed: Feb. 5, 1990

[51] Int. Cl.[5] ..... F26B 5/00; A41D 19/00

[52] U.S. Cl. ..... 223/78; 223/84; 223/66; 34/103; 34/104; 206/278

[58] Field of Search ..... 223/78, 79, 80, 84, 223/66; 206/204, 278; 34/21, 103, 104

[56] References Cited

U.S. PATENT DOCUMENTS

| | | | |
|---|---|---|---|
| 1,319,579 | 10/1919 | Gillam | 223/78 |
| 1,931,324 | 10/1933 | Newton | 223/78 |
| 2,035,094 | 3/1936 | Palicki | 223/78 |
| 2,091,942 | 8/1937 | Gemeiner | 223/78 |
| 2,524,285 | 10/1950 | Chezum | 223/78 |
| 3,133,682 | 5/1964 | Sawyer | 223/78 |
| 3,409,142 | 11/1968 | Mechaneck | 223/78 |
| 4,209,913 | 7/1980 | Wallin | 223/79 |
| 4,565,287 | 1/1986 | Rede | 223/78 |
| 4,613,066 | 9/1986 | Saucy | 223/66 |
| 4,697,724 | 10/1987 | Pitcher | 223/78 |

*Primary Examiner*—Werner H. Schroeder

*Assistant Examiner*—Bibhu Mohanty

*Attorney, Agent, or Firm*—Leon Gilden

[57] ABSTRACT

An apparatus including a main body member configured as a hand to receive a glove thereon to maintain the glove in a stretched and shaped configuration to prevent drying and shrinking of the glove. The main body includes a matrix of openings therethrough permitting air circulation throughout, as well as a loop formed on a lowermost end of the body to enhance directing of the body interiorly of an associated glove. The palm includes a recess to permit an individual to manually grasp a glove in directing the glove over the body. Modifications of the instant invention include the main body formed of a woven, porous mesh permitting air circulation therethrough, with the mesh formed with an interior fabric liner to receive and subsequently direct preservation oils into a glove mounted on the body. Furthermore, a central core sponge may be utilized to provide a reservoir of oil to be directed through the cloth liner and the mesh body into an associated glove. The mesh body is malleable to permit the fingers to be manipulated to enable stretching of a glove mounted on the body.

4 Claims, 4 Drawing Sheets

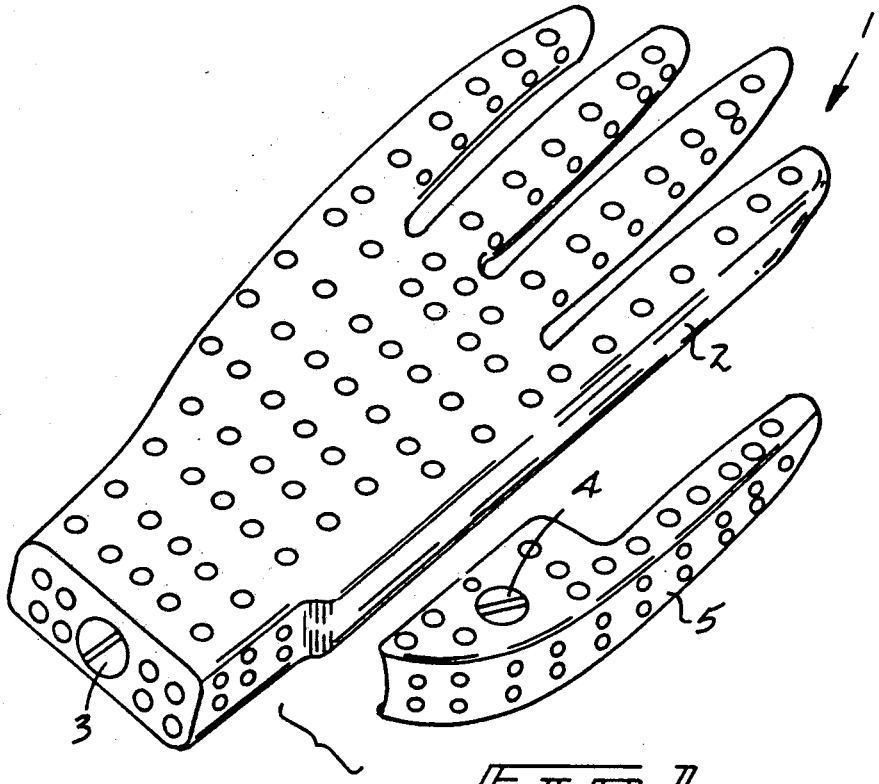
Fig 1
PRIOR ART
Fig 2
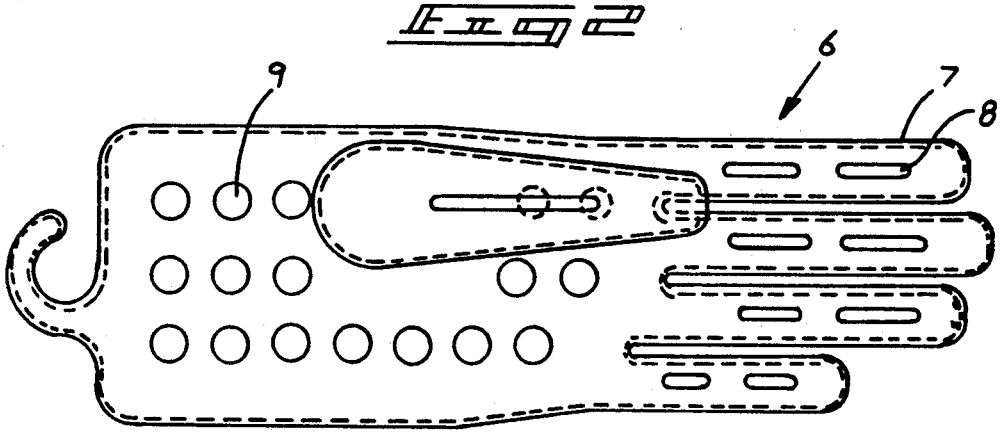
PRIOR ART

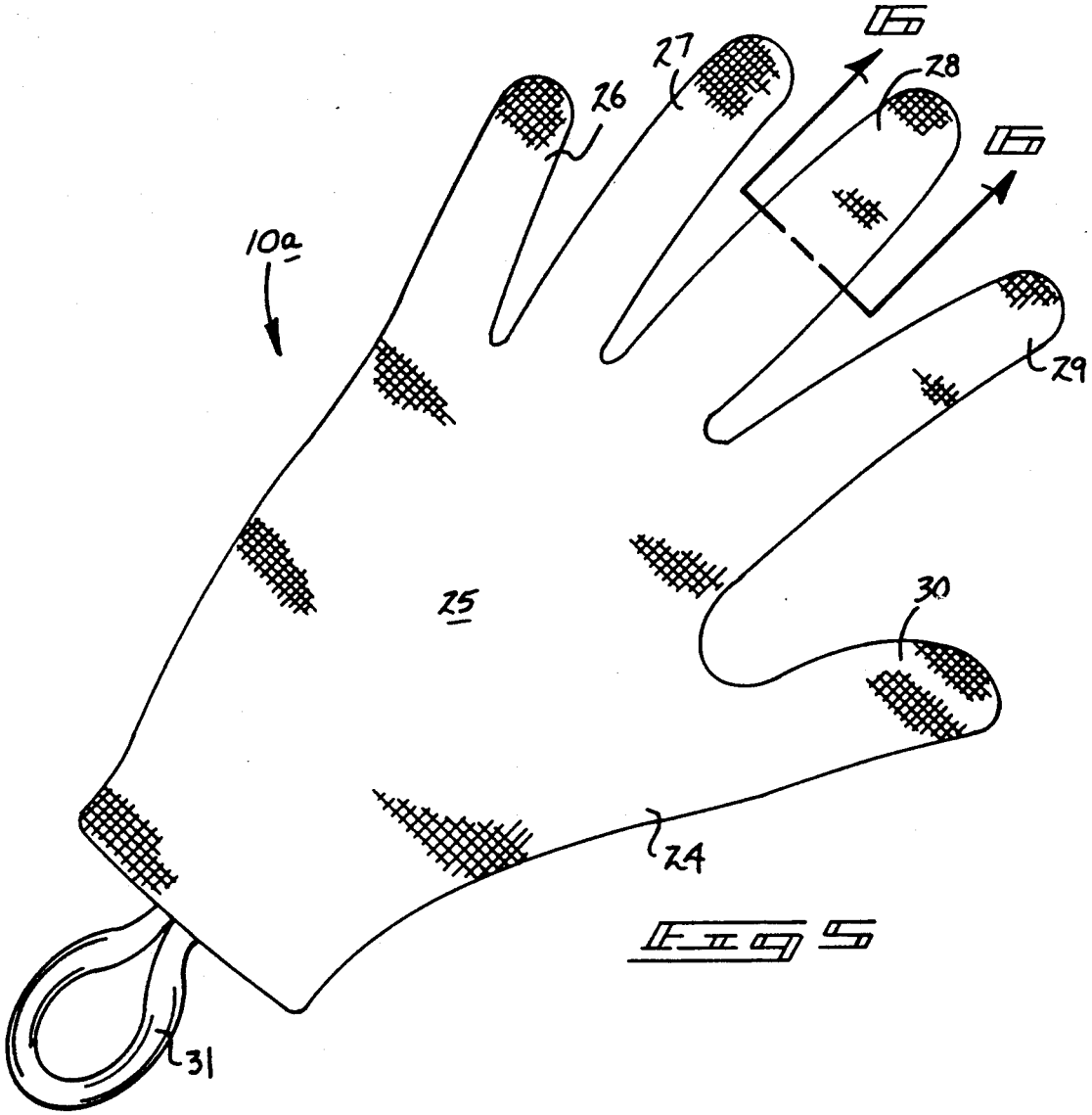
Fig 5
Fig 6
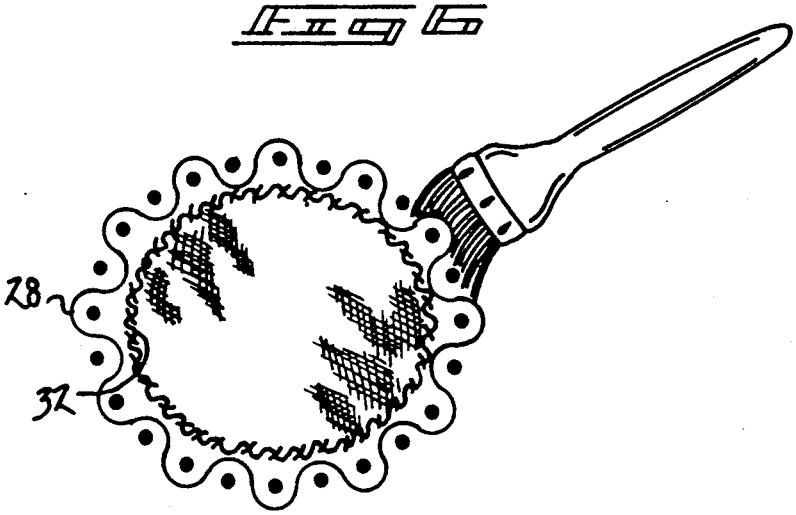

GLOVE SUPPORT APPARATUS

BACKGROUND OF THE INVENTION

1. Field of the Invention

The field of invention relates to glove support apparatus, and more particularly pertains to a new and improved glove support apparatus wherein the same permits air circulation and directing of oils and emollients onto a glove mounted on the apparatus.

2. Description of the Prior Art

The use of glove support apparatus is known in the prior art. Heretofore, however, glove support apparatus has been of expansive and unnecessarily complicated construction to mount gloves thereon to preserve their geometric configuration and prevent shrinking during storage. Examples of the prior art include U.S. Pat. No. 4,565,287 to Rede, et al., wherein a rigid form is mounted interiorly of a glove with a separate thumb portion, wherein each form includes a hollow cavity, and wherein each form is receivable within a pouch formed with an oil impregnated liner to receive the glove forms therewithin.

U.S. Pat. No. 2,524,285 to Chezum illustrates the use of a glove form formed with openings therethrough to permit draining of dirt and debris from the glove subsequent to a washing, wherein the form is provided with a hook to suspend the form during a drying procedure subsequent to a washing of the glove.

U.S. Pat. No. 2,035,094 to Plicki is illustrative of a glove form of a rigid construction formed with a removable thumb to mount a glove thereon.

U.S. Pat. No. 3,409,142 to Mechaneck illustrates a stand for drying gloves, wherein the stand is of a generally rigid construction to enable drying of the glove subsequent to washing thereof, or merely a convenient support of gloves.

U.S. Pat. No. 4,697,724 to Pitcher illustrates a glove form, wherein the digital ends of the fingers and thumb of the glove form are enlarged to save materials in the construction of the organization.

As such, it may be appreciated that there is a continuing need for a new and improved glove support apparatus wherein the same addresses both the problems of ease of use in insertion within an associated glove, as well as effectiveness in the geometric protection of the glove's configuration and for directing preservatives into the glove during support thereon.

SUMMARY OF THE INVENTION

In view of the foregoing disadvantages inherent in the known types of glove support apparatus now present in the prior art, the present invention provides a glove support apparatus wherein the same is readily and conveniently inserted within an associated glove for preserving the glove and maintaining its geometric configuration. As such, the general purpose of the present invention, which will be described subsequently in greater detail, is to provide a new and improved glove support apparatus which has all the advantages of the prior art glove support apparatus and none of the disadvantages.

To attain this, the present invention provides a main body member configured as a hand to receive a glove thereon to maintain the glove in a stretched and shaped configuration to prevent drying and shrinking of the glove. The main body includes a matrix of openings therethrough permitting air circulation throughout, as well as a loop formed on a lowermost end of the body to enhance directing of the body interiorly of an associated glove. The palm includes a recess to permit an individual to manually grasp a glove in directing the glove over the body. Modifications of the instant invention include the main body formed of a woven, porous mesh permitting air circulation therethrough, with the mesh formed with an interior fabric liner to receive and subsequently direct preservation oils into a glove mounted on the body. Furthermore, a central core sponge may be utilized to provide a reservoir of oil to be directed through the cloth liner and the mesh body into an associated glove. The mesh body is malleable to permit the fingers to be manipulated to enable stretching of a glove mounted on the body.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved glove support apparatus which has all the advantages of the prior art glove support apparatus and none of the disadvantages.

It is another object of the present invention to provide a new and improved glove support apparatus which may be easily and efficiently manufactured and marketed.

It is a further object of the present invention to provide a new and improved glove support apparatus which is of a durable and reliable construction.

An even further object of the present invention is to provide a new and improved glove support apparatus which is susceptible of a low cost of manufacture with regard to both materials and labor, and which accordingly is then susceptible of low prices of sale to the consuming public, thereby making such glove support apparatus economically available to the buying public.

Still yet another object of the present invention is to provide a new and improved glove support apparatus which provides in the apparatuses and methods of the prior art some of the advantages thereof, while simultaneously overcoming some of the disadvantages normally associated therewith.

Still another object of the present invention is to provide a new and improved glove support apparatus wherein the same is readily and conveniently positioned within an associated glove and arranged for directing various emollients and oils within the glove.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art glove support apparatus.

FIG. 2 is a top orthographic view of a further prior art glove support apparatus.

FIG. 5 is a top orthographic view of a modified glove support apparatus of the instant invention.

FIG. 6 is an orthographic view taken along the lines 6—6 of FIG. 5 in the direction indicated by the arrows.

DESCRIPTION OF THE PREFERRED EMBODIMENT

Figure 3:
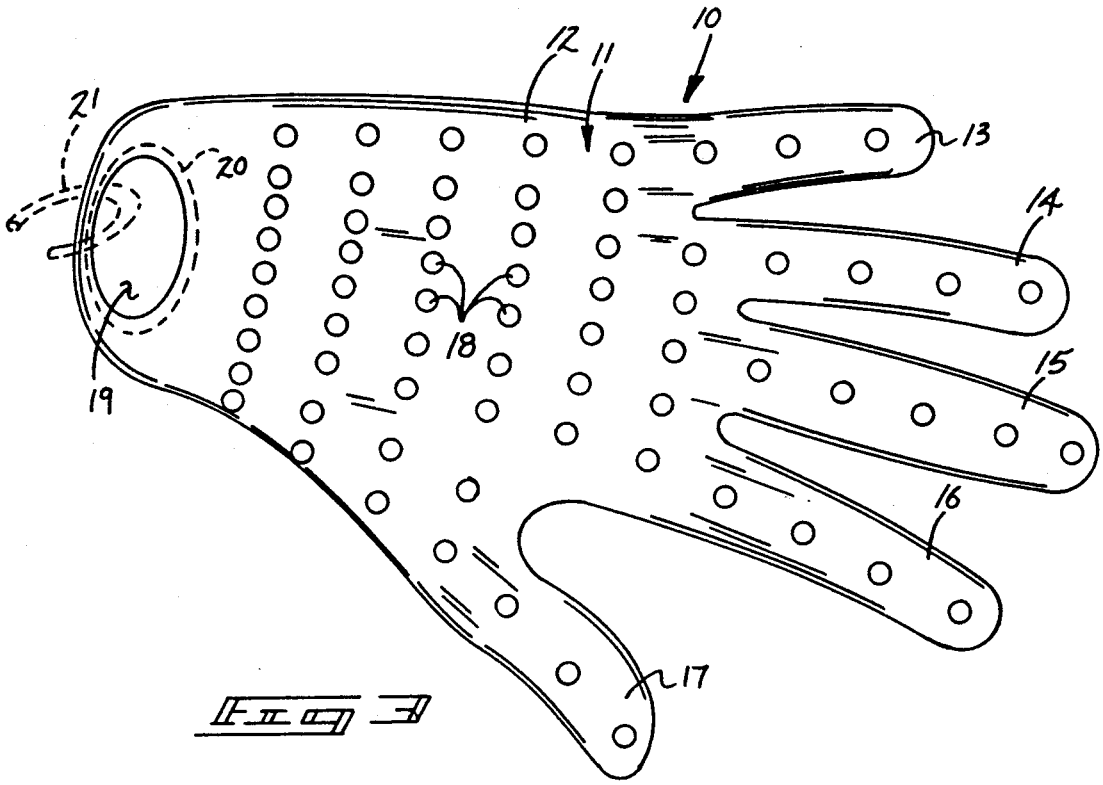
FIG. 3 is a top orthographic view of the glove support apparatus of the instant invention.
Figure 4:
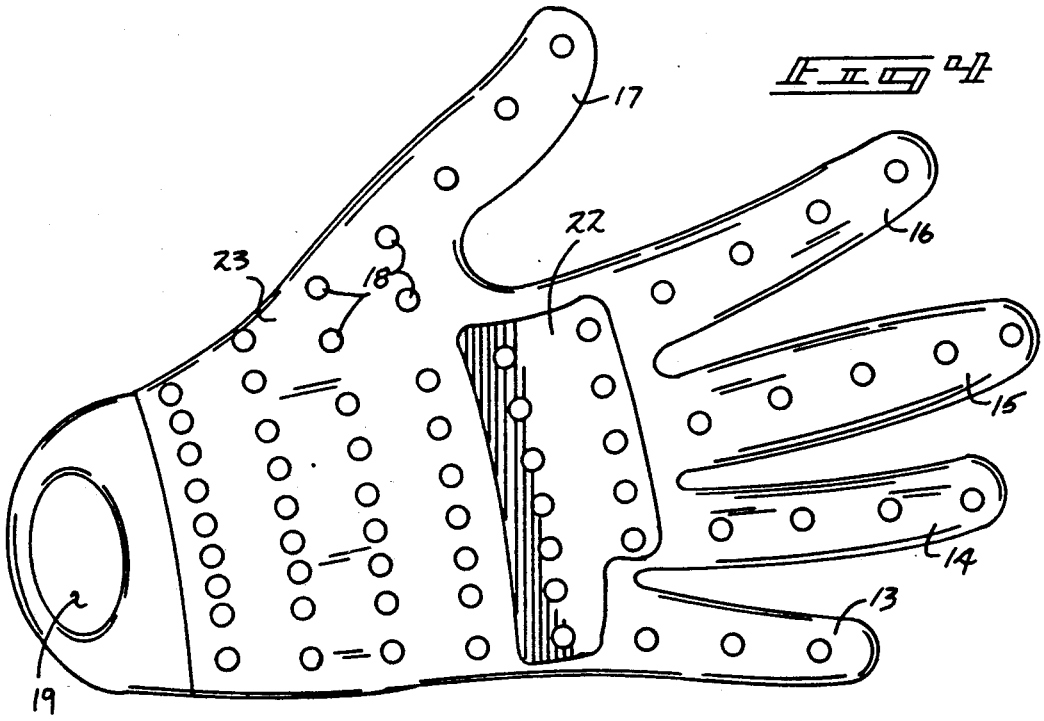
FIG. 4 is a bottom orthographic view of the glove support apparatus of the instant invention.

With reference now to the drawings, and in particular to FIGS. 1 to 8 thereof, a new and improved glove support apparatus embodying the principles and concepts of the present invention and generally designated by the reference numeral 10 will be described.

FIG. 1 is illustrative of a prior art glove support apparatus 1 defined as a solid rigid form 2 mounting a series of apertures therethrough. A thumb portion 5 is formed as a separate unit, wherein the thumb support portion 5 and the member 2 each include a separate chamber with access thereto by respective threaded plugs 3 and 4 to position dehydrating agents interiorly thereof. FIG. 2 is an orthographic view illustrating the further prior art glove support apparatus 6 formed as a rigid member 7, with slots 8 and apertures 9 directed therethrough, whereupon subsequent to a washing of an associated glove mounted upon the organization, drainage is enhanced by the various slots and apertures. A hook is mounted rearwardly of the organization to permit mounting the glove upon a line or the like to orient the glove in a downward orientation to accommodate a drying procedure.

More specifically, the glove support apparatus 10 of the instant invention essentially comprises a main body member 11 configured as a hand, and wherein the body member 11 is of a rigid configuration. The body member is defined by a top surface 12 overlying a bottom surface 23. The body member includes a respective first, second, third, fourth, and fifth finger projection 13, 14, 15, 16, and 17 respectively that are directed outwardly and aligned with the body member 11. A matrix of through-extending apertures 18 permit air circulation throughout a glove mounted overlying the body member 11. Further, an oval opening 19 is formed through a bottommost end of the body member remote from the finger projections, with a reinforcing cord 20 to permit a flexible securement line 21 to be directed through the oval opening to enable mounting and positioning of the body member 11, as desired by an individual. The bottom surface 23 is formed with a palm cavity 22 to assist in the stretching of a glove over the body member, wherein the cavity permits an individual to direct and gather the glove to assist in its being directed over the body member.

Figure 7:
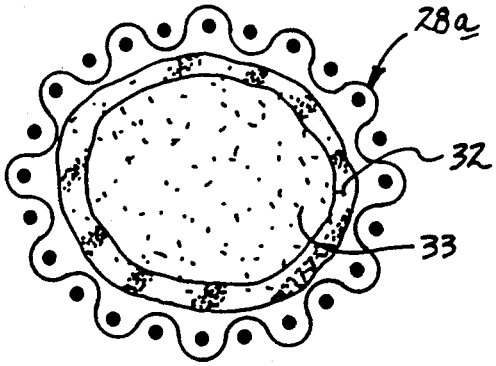
FIG. 7 is further modified glove support apparatus illustrating the use of a central sponge core.
Figure 8:
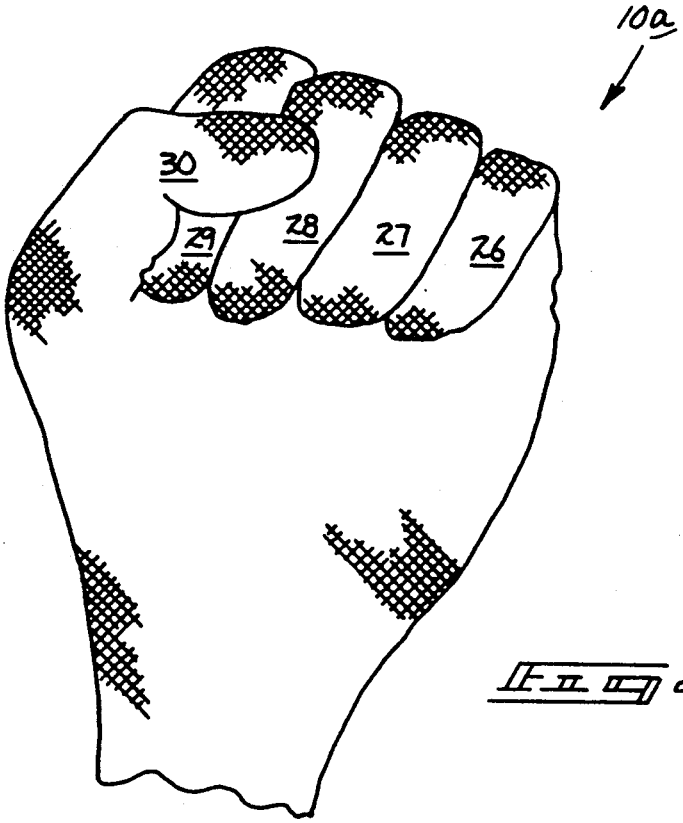
FIG. 8 is an isometric illustration of the instant invention in contracted configuration to enable stretching of an associated glove mounted thereon.

Reference to FIG. 5 illustrates a modified glove support apparatus 10 formed of a malleable woven wire mesh body 24 defined by a central body member, including a respective first, second, third, fourth, and fifth finger projection 26, 27, 28, 29, and 30. The mesh body includes a flexible loop 31 mounted at a lowermost end thereof spaced from the finger projections to again enable suspension and securement of the body member to its predetermined support. FIG. 6 illustrates the interior defined throughout the body member 25, wherein an absorbent cloth liner 32 is laminated coextensively throughout the interior surface of the body member 25 to absorb and direct a preserving oil to an overlying glove mounted on the body member. Further, FIG. 7 illustrates a further modified internal configuration of the main body member wherein in addition to the cloth liner 32, a sponge core 33 is mounted coextensively throughout the interior cavity of the body member. The sponge core serves as storage for the oils and emollients to provide a more extensive and prolonged application of such oils and enable an enhanced and prolonged storage of an associated glove mounted to the body member. It is understood of course that a mirror image right hand support stand is provided in addition to the left hand support stand of identical construction accommodating the right hand of a glove pair.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A glove support apparatus comprising, a curvilinear glove shaped body member including a top surface and a bottom surface, and five finger projections, and a matrix of openings formed throughout the body member, and a flexible loop member fixedly mounted to a rear portion of the body member remote from the finger projections, and wherein the bottom surface of the body member includes a cavity directed interiorly of the body member adjacent the five finger projections.

2. An apparatus as set forth in claim 1 wherein the body member is formed of a malleable woven mesh defining the openings therethrough.

3. An apparatus as set forth in claim 2 wherein the body member defines a central cavity, the central cavity includes an interior surface, wherein the interior surface is laminated with a fabric liner, the liner absorbing and directing preservative oils and emollients into a glove mounted on the body member.

4. An apparatus as set forth in claim 3 wherein the central cavity of the body member further includes a sponge coextensively formed within the central cavity interiorly of the liner to provide storage for the oils and emollients.

* * * * *